US008596354B2

(12) United States Patent
Hartshorne et al.

(10) Patent No.: US 8,596,354 B2
(45) Date of Patent: Dec. 3, 2013

(54) DETECTION OF TRACERS USED IN HYDROCARBON WELLS

(75) Inventors: Robert Seth Hartshorne, Newmarket (GB); Nathan Lawrence, Huntingdon (GB); Timothy Jones, Cottenham (GB); Andrew Meredith, Cambridge (GB); Gary John Tustin, Sawston (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 367 days.

(21) Appl. No.: 12/753,229

(22) Filed: Apr. 2, 2010

(65) Prior Publication Data

US 2011/0240287 A1 Oct. 6, 2011

(51) Int. Cl.
*E21B 47/00* (2012.01)

(52) U.S. Cl.
USPC ..... 166/252.6; 166/250.12

(58) Field of Classification Search
None
See application file for complete search history.

(56) References Cited

U.S. PATENT DOCUMENTS

| | | | | |
|---|---|---|---|---|
| 4,003,431 | A | 1/1977 | Novotny et al. | |
| 4,807,469 | A | 2/1989 | Hall | |
| 4,986,354 | A | 1/1991 | Cantu et al. | |
| 5,077,471 | A | 12/1991 | Smith, Jr. et al. | |
| 5,223,117 | A * | 6/1993 | Wrighton et al. | 204/415 |
| 5,324,356 | A | 6/1994 | Goodwin | |
| 5,783,822 | A | 7/1998 | Buchanan et al. | |
| 5,892,147 | A | 4/1999 | Garnes et al. | |
| 5,922,652 | A | 7/1999 | Kowalski et al. | |
| 5,979,245 | A | 11/1999 | Hirano et al. | |
| 6,645,769 | B2 | 11/2003 | Tayebi et al. | |
| 6,672,385 | B2 | 1/2004 | Kilaas et al. | |
| 6,682,647 | B1 | 1/2004 | Wang | |
| 6,714,872 | B2 | 3/2004 | DiFoggio et al. | |
| 6,723,683 | B2 | 4/2004 | Crossman et al. | |
| 6,799,634 | B2 | 10/2004 | Hartog et al. | |
| 6,818,354 | B2 | 11/2004 | Saisho et al. | |
| 6,818,594 | B1 | 11/2004 | Freeman et al. | |
| 6,840,316 | B2 * | 1/2005 | Stegemeier et al. | 166/250.12 |
| 6,942,771 | B1 | 9/2005 | Kayyem | |
| 6,993,432 | B2 | 1/2006 | Jenkins et al. | |
| 7,028,773 | B2 | 4/2006 | Fujisawa et al. | |
| 7,032,662 | B2 * | 4/2006 | Malone et al. | 166/252.6 |

(Continued)

FOREIGN PATENT DOCUMENTS

| | | |
|---|---|---|
| EP | 1277051 B1 | 8/2006 |
| EP | 1774137 B1 | 2/2008 |

(Continued)

OTHER PUBLICATIONS

Barglik-Chory et al: "Synthesis, structure and spectroscopic characterization of water-soluble CdS nanoparticles"; Chemical Physics Letters 379 (2003) 443-451.

(Continued)

*Primary Examiner* — Shane Bomar
*Assistant Examiner* — Silvana Runyan

(57) ABSTRACT

In an arrangement for monitoring of flow within a hydrocarbon well or reservoir by means of one or more tracers which are placed at subterranean locations such that they may be present in flow produced from the well, the analysis of the flow produced from the well is carried out using an electrochemical method, preferably voltammetry, to detect tracer chosen to undergo a detectable electrochemical reaction. The tracer may be provided as nanoparticles in the well fluid.

22 Claims, 8 Drawing Sheets

(56) References Cited

U.S. PATENT DOCUMENTS

| | | | | |
|---|---|---|---|---|
| 7,056,008 | B2 | 6/2006 | Rondeau et al. | |
| 7,347,260 | B2 | 3/2008 | Ferguson et al. | |
| 7,387,159 | B2 | 6/2008 | Fitzgerald | |
| 7,389,706 | B2 | 6/2008 | Bratton et al. | |
| 7,407,566 | B2 | 8/2008 | Jiang et al. | |
| 7,410,011 | B2 | 8/2008 | Anderson | |
| 7,424,911 | B2 * | 9/2008 | McCarthy et al. | 166/250.12 |
| 7,470,321 | B2 | 12/2008 | Chan et al. | |
| 7,472,748 | B2 | 1/2009 | Gdanski et al. | |
| 7,473,672 | B2 | 1/2009 | Kotlar et al. | |
| 7,767,461 | B2 * | 8/2010 | Jiang et al. | 436/79 |
| 7,901,555 | B2 * | 3/2011 | Jiang et al. | 204/416 |
| 2003/0006036 | A1 | 1/2003 | Malone et al. | |
| 2003/0056952 | A1 | 3/2003 | Stegemeier et al. | |
| 2004/0204856 | A1 | 10/2004 | Jenkins et al. | |
| 2005/0194144 | A1 | 9/2005 | Vargo, Jr. et al. | |
| 2006/0052251 | A1 | 3/2006 | Anderson et al. | |
| 2006/0054501 | A1 | 3/2006 | Jiang et al. | |
| 2006/0155472 | A1 | 7/2006 | Venkataramanan et al. | |
| 2006/0243603 | A1 | 11/2006 | Jiang et al. | |
| 2007/0065337 | A1 | 3/2007 | Jiang et al. | |
| 2007/0095528 | A1 * | 5/2007 | Ziauddin et al. | 166/252.3 |
| 2007/0272552 | A1 | 11/2007 | Jiang et al. | |
| 2008/0023328 | A1 | 1/2008 | Jiang et al. | |
| 2008/0028858 | A1 | 2/2008 | Hall et al. | |
| 2008/0179094 | A1 | 7/2008 | Repin et al. | |
| 2008/0262735 | A1 | 10/2008 | Thigpen et al. | |
| 2009/0025470 | A1 | 1/2009 | Green et al. | |
| 2009/0078036 | A1 | 3/2009 | Terabayashi et al. | |
| 2009/0090176 | A1 | 4/2009 | Toribio et al. | |
| 2009/0127179 | A1 | 5/2009 | Hamid et al. | |
| 2009/0178921 | A1 | 7/2009 | Lawrence et al. | |
| 2009/0288692 | A1 | 11/2009 | Haeberle et al. | |
| 2011/0239754 | A1 * | 10/2011 | Dyer et al. | 73/152.18 |

FOREIGN PATENT DOCUMENTS

| | | | |
|---|---|---|---|
| EP | 1886980 | A1 | 2/2008 |
| GB | 2396170 | A | 6/2004 |
| GB | 2447041 | A | 9/2008 |
| WO | 0163094 | A1 | 8/2001 |
| WO | W02001081914 | A1 | 11/2001 |
| WO | 2005113468 | A1 | 12/2005 |
| WO | 2007034131 | A1 | 3/2007 |
| WO | W02007102023 | A1 | 9/2007 |
| WO | 2008024448 | A1 | 2/2008 |
| WO | 2008080565 | A2 | 7/2008 |
| WO | 2008117024 | A2 | 10/2008 |
| WO | 2009090494 | A2 | 7/2009 |

OTHER PUBLICATIONS

Cheng et al: "Electrochemical Detection of O,O-Diethyldithiophosphoric Acid at a Tosflex Film Modified Glassy Carbon Electrode"; Electroanalysis 14 (2002) 767.

Compton et al: "Dual activation: Coupling ultrasound to electrochemistry"; Electrochimica Acta 42 (1997) 2919-2927.

Cooley, B B: "Nitrate in Drilling Fluid as a Tracer Ion"; Conference Paper SPWLA 12th Annual Logging Symposium May 2-5, 1971.

Cooley, B B: "Nitrate in Drilling Fluid as a Tracer Ion"; published in the Log Analyst Jan.-Feb. 1972.

Davis et al: "Electrochemical detection of nitrate and nitrite at a copper modified electrode"; Analyst, 125 (2000) 737-741.

Du et al: "Interwell tracer tests:lessons learnt from past field studies"; SPE paper 93140 (2005).

Ferreyra et al: "An amperometnic nitrate reductase-phenosafranin electrode: kinetic aspects and analytical applications"; Bioelectrochemistry, 64 (2004) 61-70.

He et al: "Voltammetric method based on an ion-pairing reaction for the determination of trace amount of iodide at carbon-paste electrodes", Analytical Sciences 19 (2003) 681.

Kalvoda et al: "Adsorptive Stripping Voltammetry in Trace Analysis"; Pure & Appl. Chem., vol. 61, No. 1, pp. 97-112, 1989.

Kim et al: "Selection of mediators for bioelectrochemical nitrate reduction"; Biotechnology and Bioprocess Engineering, 10 (2005) 47-51.

Kim et al: "Chronocoulometric determination of nitrate on silver electrode and sodium hydroxide electrolyte"; Analyst, 132 (2007) 350-357.

Lawrence et al: "Advances in the Voltammetric Analysis of Small Biologically Relevant Compounds"; Anal. Biochem., 303 (2002) 1-16.

Legeai et al: "Differential pulse voltammetry at microdisk electrodes"; Electrochimica Acta 50 (2005) 4089-4096.

Marin et al: "Direct electrochemical stripping detection of cystic-fibrosis-related DNA linked through cadmium sulfide quantum dots"; Nanotechnology 20 (2009) 055101.

Merkoci et al: "Crystal and electrochemical properties of water dispersed CdS nanocrystals obtained via reverse micelles and arrested precipitation"; Nanotechnology 17 (2006) 2553-2559.

Merkoci et al: "Detection of cadmium sulphide nanoparticles by using screen-printed electrodes and a handheld device"; Nanotechnology 18 (2007) 035502.

Moorcroft et al: "Detection and determination of nitrate and nitrite: a review" Talanta, 54_785-803 (2001).

Nava et al: "Tracer Detection by Laser Specroscopy for Applications in oil and gas industry" SPE paper 124689, 2009: pp. 1-7.

Shiddiky et al: "Simultaneous analysis of nitrate and nitrite in a microfluidic device with a Cu-complex-modified electrode"; Electrophoresis, 27 (2006) 4545-4554.

Solak et al: "Square wave voltammetric determination of nitrate at a freshly copper plated glassy carbon electrode"; Anal. Letts., 38 (2005) 271-280.

Wang J et al: "Electrochemical Coding Technology for Simultaneous Detection of Multiple DNA Targets" JACS vol. 125, No. 11, pp. 3214-3215_(2003).

Wang J et al: "Mercury-Free Disposable Lead Sensors Based on Potentiometric Stripping Analysis at Gold-Coated Screen-Printed Electrodes"; Anal. Chem. 1993, 65, 1529-1532.

Wang J et al: "Remote Electrochemical Sensor for Trace Metal Contaminants"; Anal. Chem. 1995, 67, 1481-1485.

Wang J et al: "Renewable-Reagent Electrochemical Sensor for Monitoring Trace Metal Contaminants"; Anal. Chem. 1997_69_2640-45.

Wang J, "Analytical Electrochemistry", published Wiley-VCH, 2000 p. 81.

Wang X. J. et al: "Conductometric nitrate biosensor based on methyl viologen/Nafion (R)/nitrate reductase interdigitated electrodes"; Talanta, 69 (2006) 450-455.

Wang Y et al: "Electrocatalytic reduction of nitrate in water with a palladium-modified copper electrode Water Environment Research"; 78 (2006) 724-729.

Wang Y et al: "The electrocatalytic reduction of nitrate in water on Pd/Sn-modified activated carbon fiber electrode"; Water Research, 40 (2006) 1224-1232.

Wu et al: "Use of a Boron-Doped Diamond Electrode for Amperometric Assay of Bromide and Iodide Ions"; J. Anal. Chem. 60 (2005) 1062-1068.

Zemel, B.: (1995) Tracers in the Oilfield, Developments in Petroleum Science 43, Elsevier Science, New York.

Brett C and Brett A M O; "Electrochemistry: principles methods and applications" Oxford University Press 1993; pp. 174-198.

Brett C and Brett A M O; "Electrochemistry: principles methods and applications" Oxford University Press 1993; pp. 214-223.

Afanasyev et al., "Multiphase Fluid Samples: A Critical Piece of the Puzzle," Oilfield Review, 2009, vol. 21(2): pp. 30-37.

Anisimov et al, "SPE 118862: The Use of Tracers for Reservoir Characterization," SPE International, 2009: pp. 1-8.

Atkinson et al., "New Generation Multiphase Flowmeters from Schlumberger and Framo Engineering AS," 17th International North Sea Flow Measurement Workshop, 1999: pp. 1-12.

Brett et al., "Electrochemistry Principles, Methods, and Applications," Oxford University Press: New York, 1993: pp. 174-198 and 214-223.

(56) References Cited

OTHER PUBLICATIONS

Cockin et al., "Analsis of a Single-Well Chemical Tracer Test to Measure the Residual Oil Saturation to a Hydrocarbon Miscible Gas Flood at Prudhoe Bay," SPE Reserboir Eval. & Eng., Dec. 2000, vol. 3(6): pp. 544-551.
Devegowda et al., "SPE 119125: Interpretation of Partitioning Interwell Tracer Tests Using EnKF with Coarse-Scale Constraints," SPE International, 2009: pp. 1-23.
Florence et al., "Response" and Skogerboe et al., "Exchange of Comments on Scheme for Classification of Heavy Metal Species in Natural Waters," Anal. Chem., 1980, vol. 52: pp. 1860-1963.
Fuller et al., "SPE 124749: Applying Biochemistry Concepts to the Analysis of Oilfield Produced Fluids," SPE International, 2009: pp. 1-10.
Guan et al., "Advances of Interwell Tracer Analysis in the Petroleum Industry," Journal of Canadian Petroleum Technology, May 2005, vol. 44(5): pp. 12-15.
Hanrahan et al., "Electrochemical sensors for environmental monitoring: design, development and applications," J. Environ. Monit., 2004, vol. 6: pp. 657-664.
Hansen et al., "Voltammetric Oxidation of Some Biologically Important Xanthines at the Pyrolytic Graphite Electrode," J. Electroanal. Chem., 1971, vol. 30: pp. 417-426.
Hansen et al., "Quantum-Dot/Aptamer-Based Ultrasensitive Multi-Analyte Electrochemical Biosensor," J. Am. Chem. Soc., 2006, vol. 128: pp. 228-229.
Howell et al., "The determination of trace metals in estuarine and coastal waters using a voltammetric in situ profiling system," Analyst, 2003, vol. 128: pp. 734-741.
Huseby et al., "Improved Understanding of Reservoir Fluid Dynamics in the North Sea Snorre Field by Combining Tracers, 4D Seismic and Production Data," SPE Reservoir Evaluation & Engineering, Aug. 2008: pp. 768-777.
Huseby et al., "SPE121190: Natural and Conventional Tracers for Improving Reservoir Models Using the EnKF Approach," SPE International, 2009: pp. 1-22.
Kefala et al., "A study of bismuth-film electrodes for the detection of trace metals by anodic striping voltammetry and their application to the determination of Pb and Zn in tapwater and human hair," Talanta, 2003, vol. 61: pp. 603-610.
Khalil et al., "SPE 50768: Organic Dye for Subsea Flowline Assessment," SPE International, 1999: pp. 625-631.
Kleven et al., "SPE 35651: Non-Radioactive Tracing of Injection Gas in Reservoirs," SPE International, 1996: pp. 675-684.
Lawrence, "Amperometric Detection of Sulfide: An Electrocatalytic Reaction with Ferrocene Carboxylate," Electroanalysis, 2006, vol. 18(17): pp. 1658-1663.
Lawrence et al., "Ferrocene sulfonates as electrocatalysts for sulfide detection," Electrochimica Acta, 2006, vol. 52: pp. 499-503.
Ostapczuk, Analytica Chimica Acta, 1993, vol. 273: pp. 35-40.
Ostapczuk et al., "Square wave voltammetry—A rapid and reliable determination method of Zn, Cd, Pb, Cu, Ni and Co in biological and environmental samples," J. Electroanal. Chem., 1986, vol. 214: pp. 51-64.
Shook et al., "SPE 124614: Determining Reservoir Properties and Flood Performance From Tracer Test Analysis," SPE International, 2009: pp. 1-19.
Spãtaru et al., "Anodic Voltammetry of Xanthine, Theophylline, Theobromine and Caffeine at Conductive Diamond Electrodes and Its Analytical Application," Electroanalysis, 2002, vol. 14(11): pp. 721-728.
Tercier-Waeber et al., "Multi Physical-Chemical profiler for real-time in situ monitoring of trace metal speciation and master variables: Development, validation and field applications," Marine Chemistry, 2005, vol. 95: pp. 216-235.
Tustin et al., "Synthesis and characterisation of water soluble ferrocenes: Molecular tuning of redox potentials," Journal of Organometallic Chemistry, 2007, vol. 692: pp. 5173-5182.
Wang, "Electrochemical Sensors for Environmental Monitoring: A Review of Recent Technology," National Exposure Research Laboratory, Office of Research and Development U.S. Environmental Protection Agency, 2004: pp. 1-17.
Wang et al., "Stripping analysis into the 21st century: faster, smaller, cheaper, simpler and better," Analytica Chimica Acta, 1999, vol. 385: pp. 429-435.
Wang et al., "Electrochemical stripping detection of DNA hybridization based on cadmium sulfide nanoparticle tags," Electrochemistry Communications, 2002, vol. 4: pp. 722-726.

* cited by examiner

DETECTION OF TRACERS USED IN HYDROCARBON WELLS

FIELD OF THE INVENTION

This invention relates to the utilization of tracers in connection with monitoring hydrocarbon reservoirs and/or monitoring wellbores penetrating hydrocarbon reservoirs.

BACKGROUND OF THE INVENTION

The term tracer has generally been used to denote a material which is deliberately introduced into fluid flow which is taking place. Detection of the tracer(s) downstream of the injection point(s) provides information about the reservoir or about the wellbore penetrating the reservoir. In particular, deliberate addition of tracers has been used to observe flow paths and transit times between injection wells (used for instance to inject a water flood into a reservoir) and production wells. For this application of tracers to study inter-well flow, the tracer materials have generally been dissolved in the injection water at the surface before it is pumped down the injection well.

Some prior documents have proposed placing tracers in a well, or adjacent to it in a perforation extending through well casing into the surrounding formation, so as to monitor flow or events within the well rather than flow between wells. U.S. Pat. No. 507,771 proposed injecting radioactive tracers into perforations and monitoring loss of tracer with a wireline tool. U.S. Pat. No. 5,892,147 and U.S. Pat. No. 6,645,769 both proposed releasing distinguishable tracers from various underground locations within a wellbore and monitoring the produced flow to detect the presence of tracer. U.S. Pat. No. 6,840,316 proposed that tracer should be released under electrical control at various points within a complex hydrocarbon well and suggests a number of possible positions for sensors (of unspecified construction) to detect the presence of tracer.

In these various applications a deliberately added tracer may be present at very low concentration in the produced fluid where it is detected, and a number of prior documents have been concerned with choice of tracer material and methods of detection such that the tracer is detectable at very low concentrations. Substances deliberately introduced as tracers have included radioisotopes, fluorine-containing compounds and compounds of rare earth elements.

Whilst there are a variety of tracers and a variety of detection methods, a number of methods for detection of tracers involve the use of laboratory instruments. For example Society of Petroleum Engineers paper SPE 124689 proposes laser spectroscopy as a method of detection. WO2007/102023 proposes the use of a tracer containing a rare metal (e.g. caesium, hafnium, silver and gold) which is then detected in a sample by means of inductively coupled plasma mass spectrometry (ICP-MS).

When tracers are used, especially when the tracers do not contain radioactive isotopes, it is normal that samples are taken from the produced flow and sent away to a laboratory where solvent extraction or some other preparative procedure is carried out manually to extract and/or concentrate the tracer, after which the amount of tracer is determined by an analytical method which may be a sensitive instrumental technique. In consequence there is apt to be a significant time delay between taking the sample and obtaining an analysis of tracer(s) within it.

SUMMARY OF THE INVENTION

This invention provides a method of monitoring flow within a hydrocarbon well or a hydrocarbon reservoir penetrated by a well, comprising:

providing one or more tracer materials at one or more subterranean locations from which tracer may enter flow produced from the well, and monitoring flow within or from the well to detect the presence of one or more tracers in the flow, characterized in that the detection of tracer is carried out by an electrochemical reaction.

The subterranean location(s) at which tracer is provided may be within the reservoir, or sufficiently close to the reservoir that tracer may flow into the well. In some forms of this invention the location(s) at which tracer is placed may be within part(s) of the well.

The step of monitoring flow may entail providing electrodes connected to a source of electrical potential, bringing a sample or portion of the flow into contact with the electrodes and applying potential to the electrodes to bring about electrochemical reaction, while measuring the current flow. This may be done using one of the various forms of voltammetry in which potential applied to the electrodes is varied over a range, while measuring the current flow as potential is varied.

The analytical detection of tracer by means of electrochemical reaction may serve to give qualitative detection of the presence of a tracer or may serve to give a quantitative determination of the concentration of tracer in the flow. A considerable advantage of using an electrochemical reaction as the analytical method is that it can be carried out with apparatus that can be small in size, that is easy to use and transport and that does not need the support of an extensively equipped laboratory. The electrochemical reaction mixture may be exposed to ambient air. Thus, it is practical for the analytical determination of tracers to be carried out proximate to the well so that the results can be available quickly after a sample is taken. Analysis of samples could for instance be carried out in an office at the site of the well, or nearby. Conveniently this may for instance be done within 10 km of the well, possibly closer such as within 3 km.

It will be necessary to choose a tracer or tracers which can be detected by means of an electrochemical reaction and also arrange that the tracer(s) will be released at a sufficient concentration to be detectable in the electrochemical reaction. We have found that electrochemical redox reactions can detect some tracers at concentrations which are sufficiently low to provide a useful level of sensitivity, which is of course of particular value when it is achievable with apparatus that does not require elaborate laboratory facilities.

The tracer may be a redox active material, capable of undergoing a reduction or oxidation reaction within an electrochemical cell. There are a number of possibilities for redox-active tracers.

The tracer may be an ionic species capable of undergoing a redox reaction. One possibility is a metal ion having more than one oxidation state. For instance copper ions provided by addition of copper sulphate solution can undergo electrochemical reduction to copper metal.

Some inorganic anions can be used. Halides such as chloride, bromide and iodide can undergo electrochemical oxidation to chlorate, bromate or iodate respectively. Thiocyanate ions can undergo electrochemical oxidation to trithiocyanate $(SCN)_3^-$ while nitrate ions can undergo electrochemical reduction to nitrite. Nitrate and thiocyanate ions have the advantage that they are not normally encountered in subterranean water.

A number of organic molecules undergo electrochemical redox reactions and so are detectable electrochemically. Some instances are xanthine, ascorbic acid and barbituric acid.

In a significant development of this invention, the tracer is in the form of nanoparticles containing a metal which has more than one oxidation state. Such nanoparticles can be detected in very low concentration as will be explained further below.

The electrochemical reaction to determine the presence of one or more tracers in the flow may be carried out by the well established technique of cyclic voltammetry in which the potential applied to a working electrode is cycled over a sufficient range to bring about the oxidation and reduction reactions while recording the current flow as the potential is varied. The recorded current shows peaks at the potentials associated with the reduction and oxidation reactions. It is also possible that this variation in potential whilst recording current flow could be carried out over only a portion of the reduction and oxidation cycle. This would be classed as linear scan voltammetry.

Cyclic and linear scan voltammetry are customarily performed with a continuous variation of the applied potential over a range, keeping the rate of change sufficiently slow that the analyte is able to diffuse within the electrolyte to reach the working electrode. Further possibilities are that the applied potential is varied in steps (as in square wave voltammetry) or is varied as pulses (as in differential voltammetry for instance). A discussion of various voltammetry techniques can be found in for example Brett and Brett *Electrochemistry Principles: Methods and Applications*, Oxford University Press 1993. Square wave voltammetry has been found to be effective. In this technique the potential applied to the electrodes is varied in steps superimposed on a progressive variation over a range. The resulting waveform may be such that it can be referred to as a square wave superimposed on a staircase.

Sensitivity of these voltammetric methods may be increased by movement of the electrolyte relative to the working electrode, so that the mass transport to the electrode is enhanced.

A further electrochemical technique which gives very good sensitivity to the presence of some tracer(s) is stripping voltammetry with accumulation. This technique proceeds in two stages. In the first stage the working electrode is maintained at a potential which attracts tracer to become adsorbed onto it, possibly with a redox electrochemical reaction of the tracer on the electrode. The amount of tracer which accumulates is dependent on the concentration of tracer in the solution. Then in a second stage a voltammetric scan is carried out, bringing about electrochemical reaction of the material which has been accumulated on the electrode. This voltammetric scan also strips the accumulation from the electrode. This technique can be used with metal ions (e.g. cadmium, lead, bismuth or zinc) as tracers, the metal ions being reduced during the accumulation stage and re-oxidized during the subsequent voltammetric scan. Moreover, we have found that this technique of stripping voltammetry with accumulation can be used when the tracers are nanoparticles as mentioned above. The combination of nanoparticles as tracers and stripping voltammetry with accumulation as the method of detection leads to very good sensitivity to the tracer(s). The accumulation stage will generally be longer than the subsequent detection stage. Typically it will be more than 10 times longer.

A further possibility for enhancing sensitivity of voltammetry is to employ an electrode which spontaneously adsorbs the tracer, possibly by means of a substance which is chemically bound to the electrode surface and has binding affinity for the tracer. Detection would again have two stages: a first stage during which the tracer would be adsorbed and so accumulate on the electrode, followed by a second stage in which a voltammetric scan is carried out to detect, and preferably quantitatively determine, the amount of tracer.

These methods in which tracer(s) are accumulated on the electrode before detection may also be made even more sensitive by movement of the electrolyte relative to the working electrode during the accumulation stage, so that the mass transport to the electrode is enhanced.

Yet another possibility is to selectively extract tracer at the surface by bringing the flow into contact with a material capable of absorbing tracer, notably an ion exchange matrix. Any tracer retained by this matrix could subsequently be extracted into a solution which was then subjected to the electrochemical reaction to detect the presence of one or more tracers.

Apparatus for carrying out electrochemical determinations of tracer may comprise a container for the sample under test, a plurality of electrodes to be immersed in the sample and thus form an electrochemical cell, and a potentiostat to apply potential to the electrodes and measure current flow. The potentiostat may be operated under control of a computer which also records the results obtained.

The electrodes may constitute a conventional three electrode arrangement with a working electrode at which the electrochemical reaction occurs, a reference electrode and a counter electrode. These could be of standard types already used in electrochemistry.

An alternative to the use of separate electrodes of types traditionally used in electrochemistry is to use electrodes which screen printed (or deposited in some other way) onto an insulating substrate. Such electrodes may be manufactured as disposable items for one time only use, typically having a Ag/AgCl reference electrode, a metallic counter electrode and a carbon-based working electrode all screen printed on to a single ceramic or polymeric substrate.

A further possibility is that the working electrode is formed from boron-doped diamond located on an (electrically insulating) area of intrinsic diamond as described in U.S. Pat. No. 7,407,566. As shown in that document, such a working electrode may be carried on an insulating support of material other than diamond which also has a counter electrode and a reference electrode deposited on it.

It is possible that an arrangement with more than three electrodes could be used. There could be a single reference electrode and a single counter-electrode, but a number of working electrodes with specificity to different tracers.

The invention may be used in connection with various tasks which can be performed by use of tracers.

In one form of this invention tracers are used in conventional studies of inter-well flow from one or more injection wells to one more production wells. A tracer is added to the fluid which is pumped down an injection well, and thus is provided at the subterranean location where fluid exits from the injection well into the surrounding formation. This point of exit may be in a hydrocarbon reservoir or adjacent to it so that the injected fluid can be expected to flow through the formation to a production well. Whether the fluid actually does flow to the production well and how long it takes to travel from injection well to production well are of course questions which the addition of tracer is intended to investigate.

In these circumstances samples may be taken from fluid produced from a production well and examined by subjecting them to the electrochemical reaction. As mentioned earlier, this examination of the samples may be carried out close to the well site rather than by shipping the samples away to a laboratory elsewhere.

In another form, the invention may be used to observe flow within a well. This may possibly be in the context of a simple vertical well, releasing tracer at an underground location in the well (or close to it such as in a perforation which extends into the formation) and detecting its arrival at the surface. However, using this form of the invention to observe flow within a well is of particular interest within a more complex well which has multiple entry points for fluid from the formation around the well.

A well with multiple entry points for hydrocarbon may be any of:

a well which penetrates multiple pay zones (i.e. multiple oil-bearing formations);

a well which extends laterally within a reservoir, so that hydrocarbon enters the well at multiple points along the lateral;

a well which branches below ground so as to have multiple flow paths which merge before reaching the surface. A well which branches below ground may have branches diverging at angles to the vertical or may have multiple laterals.

For any well architecture where hydrocarbon can enter the well at multiple points, it will be desirable to have knowledge of what is flowing into the well at the various entry points, especially if the well has been provided with valves for control over the flow from different parts of the well.

Tracer materials may be provided at locations distributed within such a well or at locations within the formation and close to the wellbore, such as in perforations. Whenever tracer is placed in the formation adjacent to wellbore, the location at which the tracer is placed and from which it is released into the flow is preferably not more than 1 meter upstream from the point of entry into the wellbore.

One possibility here is that tracer is released from supply containers, in response to commands from the surface, analogous to the proposal in U.S. Pat. No. 6,840,316. An alternative is that the tracer is encapsulated within a body of other material which is exposed to the flow and is liberated into the flow as a consequence of diffusion out of the encapsulating material and/or degradation of the body of encapsulating material, analogous to techniques for the controlled release of other oilfield chemicals from encapsulation, described for instance in U.S. Pat. No. 5,922,652, U.S. Pat. No. 4,986,354, U.S. Pat. No. 6,818,594 and U.S. Pat. No. 6,723,683. Such bodies may be formulated to release tracer when in contact with water (more accurately subterranean brine) penetrating into the well so that detection of tracer in the downstream flow provides an indication that water penetration is taking place. Bodies of material which encapsulates tracer may be secured to equipment which is put into the well at the time of well completion. Another possibility is that material encapsulating tracer is applied as a coating on such equipment, for example on the exterior of a tubular.

Desirably, when this invention is used for monitoring flow from a plurality of separate entry points where water penetration into a well may occur, different tracers are associated with respective different entry points. By using different tracers at different locations within the well bore, the detection of tracer can indicate the part of the well where water penetration is taking place. This is useful in the context of a complex well with control valves which can be used to regulate (for instance to shut off) flow from a part of the well penetrated by water after that part of the well subject to water penetration has been identified by means of the tracer released into the water entering the well.

In a yet further form, this invention is used in monitoring a hydraulic fracturing job. This well-known method of stimulating a well involves pumping thickened fluid into the well and out into the formation, creating a fracture of the formation. U.S. Pat. No. 7,032,662 proposed incorporating tracers into the fracturing fluid which is injected and subsequently testing the flow back produced from the well to determine the amount of each tracer in the flow back. That determination of tracers in the flow back would then be used to estimate the amount of injected material which has returned to the surface. In an example, this document proposed that the tracers in produced fluid are determined by GC-mass spectrometry. The present invention could be used in analogous manner to monitor a fracturing job, but using an electrochemical method in accordance with this invention to detect and quantify tracers in produced fluid. This could be done in the vicinity of the well, rather than sending samples way to a laboratory.

As indicated above, it is envisaged that analysis for tracer by means of an electrochemical reaction will be carried out at the surface, in the vicinity of the well. However, it is also within the scope of this invention that the electrochemical analysis for tracer could be carried out underground, using a device analogous to that shown in US 2009090176 in which electrodes are exposed to a flow of fluid to be tested for tracer.

DETAILED DESCRIPTION

Figure 1:
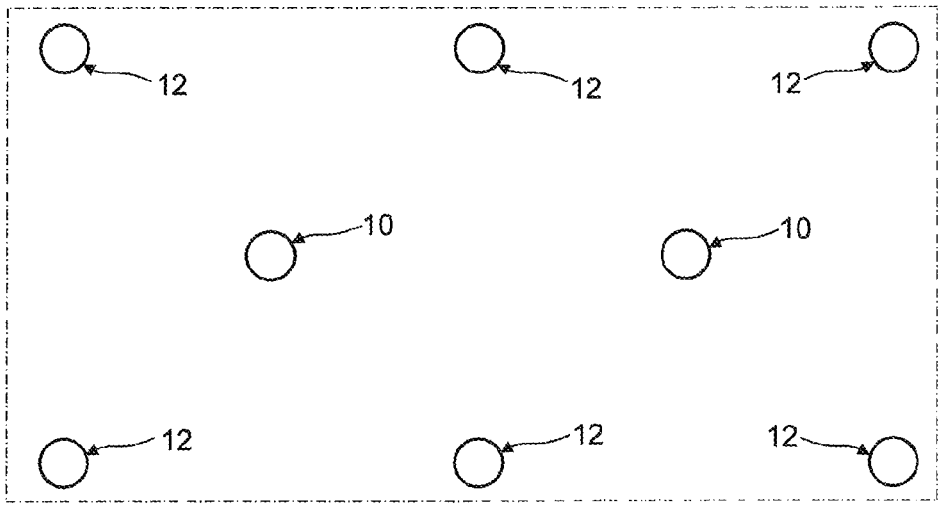
FIG. 1 is a plan view showing two production wells surrounded by injection wells.

FIG. 1 shows a typical arrangement where inter-well studies are required. Two production wells 10 are surrounded by six injection wells 12 used to inject water into the reservoir to drive oil towards the production wells. A question which has traditionally been addressed by use of tracers is whether the water from all of the injection wells is reaching the production wells. To investigate this, water-soluble tracers are added to the water flow into each injection well and the flow from each production well is then monitored for the presence of tracer.

Figure 2:
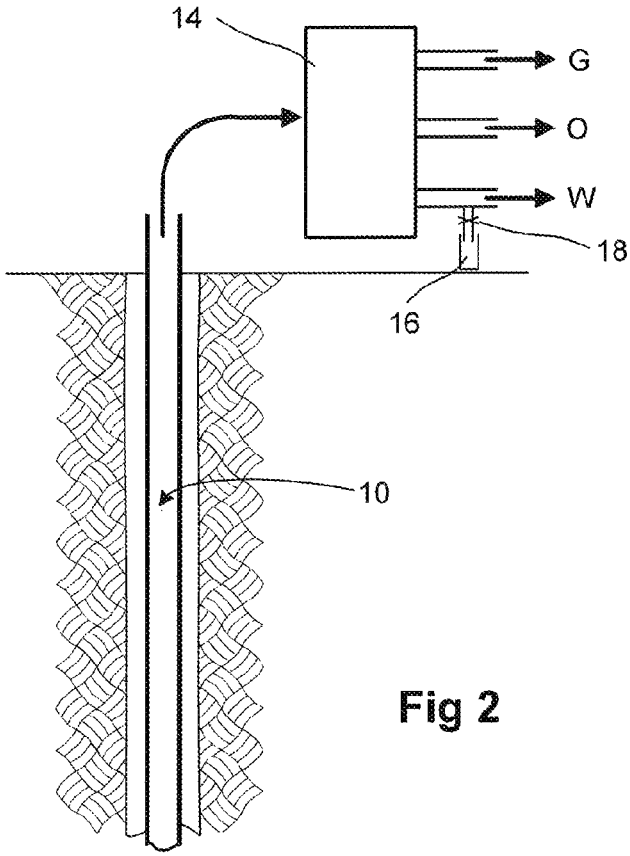
FIG. 2 diagrammatically illustrates equipment at the surface.

As shown in FIG. 2 the flow produced from each production well 10 passes through a separator 14 which separates the flow into three parts, namely gas G. liquid crude oil 0 and water W (which will be saline because it includes some brine from the formation). Samples 16 are periodically taken from the water flow W by operation of valve 18 and tested for the presence of tracer.

Figure 3:
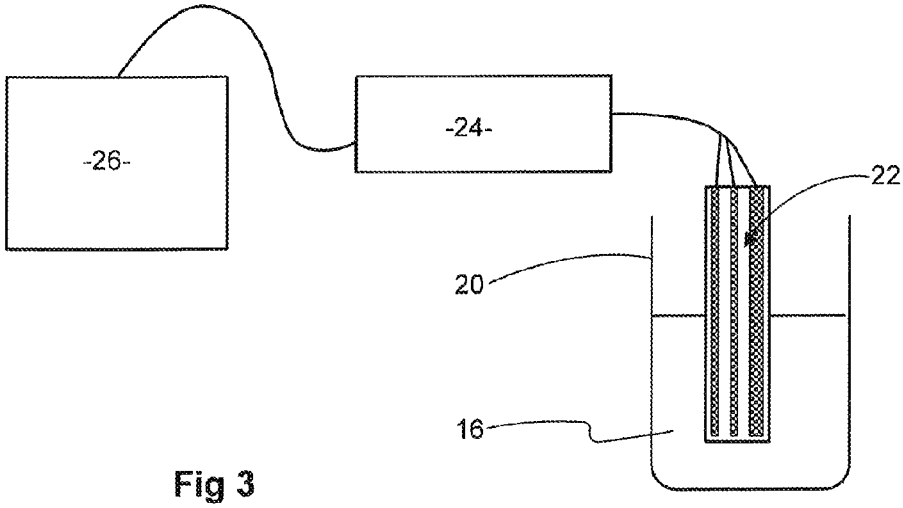
FIG. 3 shows equipment for the electrochemical determination of tracer.

In accordance with the present invention, this testing is carried out using electrochemistry and can be done in the vicinity of the well. An example of possible apparatus is shown in FIG. 3. The sample 16 is placed in a beaker 20 and a set 22 of three electrodes in the form of strips deposited onto an insulating substrate, is placed dipping into the sample 16 in the beaker 20. A potentiostat 24 is connected to the electrodes and is operated under control of computer 26 to carry out voltammetry serving to detect and quantify the tracers present.

Figure 4:
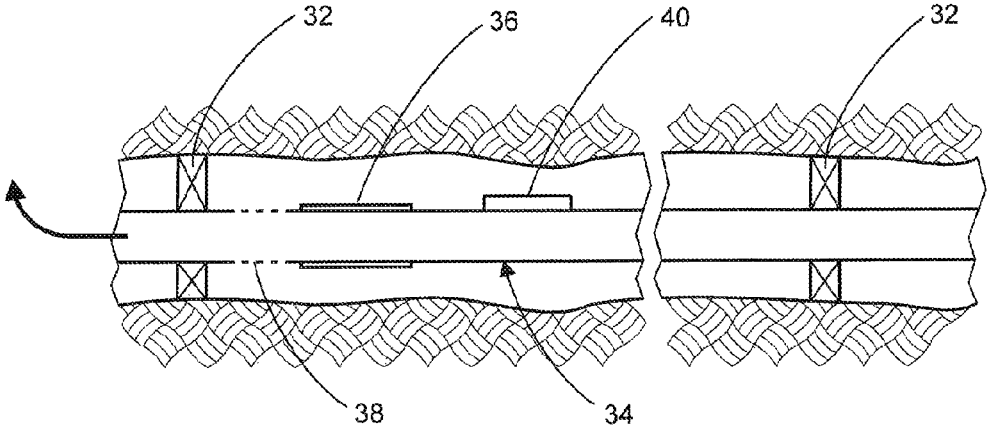
FIG. 4 show part of a subterranean lateral, in cross-section.
Figure 5:
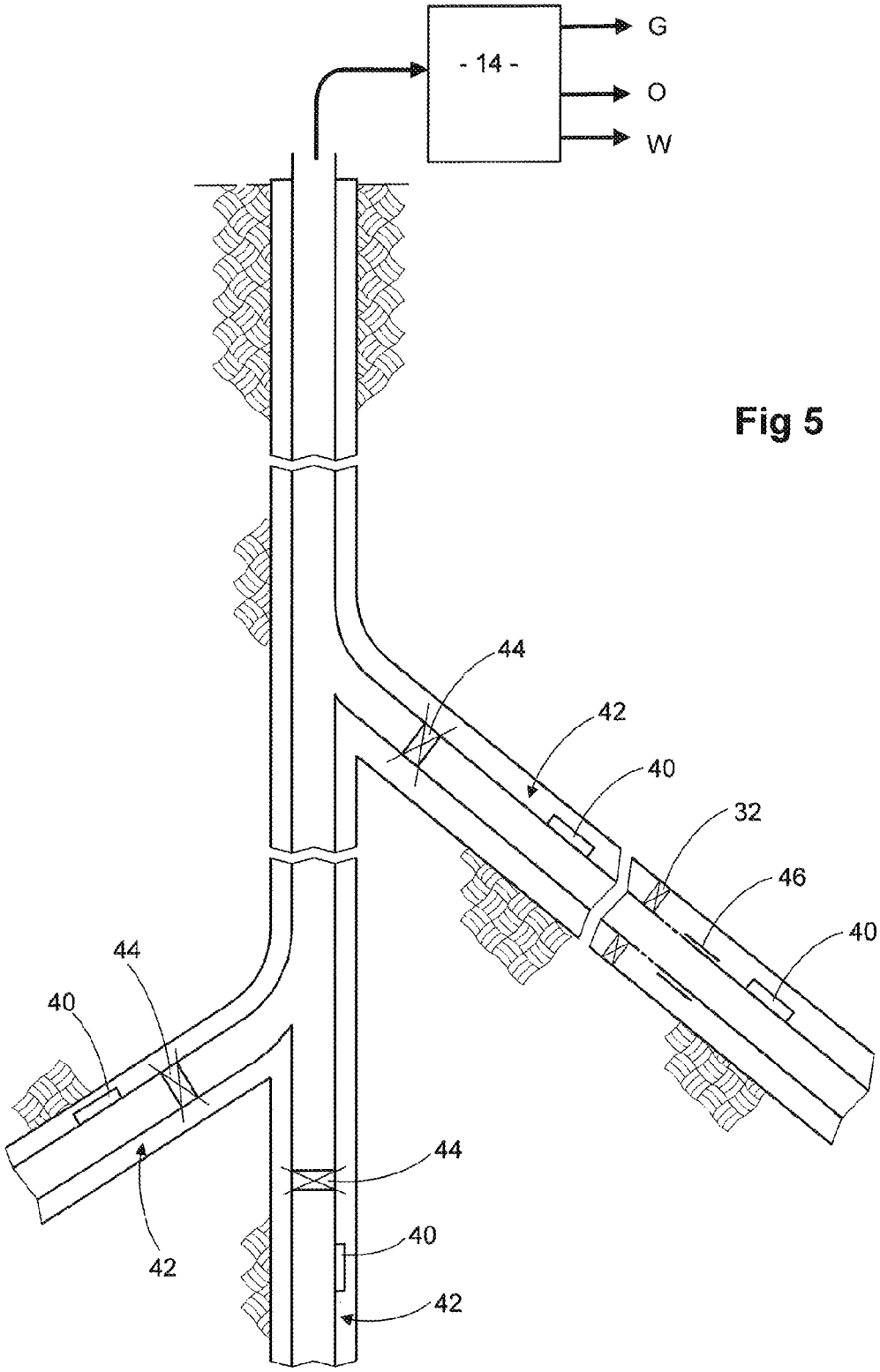
FIG. 5 shows a well with a plurality of branches, in cross-section.

FIGS. 4 and 5 illustrate a different application of tracers. The well illustrated by FIG. 4 has a long lateral which is subdivided into sections by packers 32 around the production tube 34. One section between two packers 32 is shown in FIG. 4. Within each section there is a valve arrangement which controls entry to the production tube 36. Such a valve arrangement can be of conventional construction. As an example the arrangement shown in FIG. 4 comprises a sliding sleeve 36 which can be moved to cover and close openings 38 for entry of fluid into the production tube 34, in response to a command transmitted from the surface.

A block of material 40 is secured to the exterior of the production tube 34. This material 40 encloses a tracer (a different tracer in each section) and is such that the tracer is not released if the material 40 is exposed to oil but is released if the material 40 comes into contact with formation water or brine. The material 40 may be water-soluble so as to release tracer as the material 40 dissolves, or maybe water permeable, allowing tracer to dissolve into water which permeates into and out of the block of material 40.

Consequently, so long as oil is entering each section of the wells lateral, no tracer is released. However if water penetrates into one section, tracer will be released into the water. This tracer can be detected at the surface in the same way as described above with reference to FIGS. 2 and 3.

Detection of tracer at the surface will show that water penetration is occurring (which may of course also be apparent from an increase in the quantity of water produced) but because each section of the lateral is associated with a different tracer, identification of the tracer will also show which section of the lateral has suffered water penetration. The valve arrangement, 36, 38 in that section can then be shut to prevent or restrict water entry, while allowing oil production from the other sections of the lateral to continue.

FIG. 5 diagrammatically illustrates a complex well drilled so as to have a plurality of branches 42 which merge below ground. When the completion of the well was carried out, valves 44 were incorporated which can be operated to restrict flow from a branch if needed. Each branch 42 may be subdivided into sections by packers 32, with valves 46 (akin to sleeve 36 in FIG. 4) which can be used to shut off flow into a section of a branch. In particular, one of the valves 44, 46 can be operated to shut off flow if water penetration into the flow becomes significant.

Similarly to the arrangement in FIG. 4, blocks 40 of material enclosing tracers are secured to the exterior of the production tube 34. These blocks 40 contain tracers (a different tracer in each section of each branch) which are released if the material 40 comes into contact with formation water or brine. Detection and identification of tracer at the surface will show where water penetration is occurring and the affected branch or part of a branch can be shut off by operation of the relevant valve 44 or 46.

Figure 6:
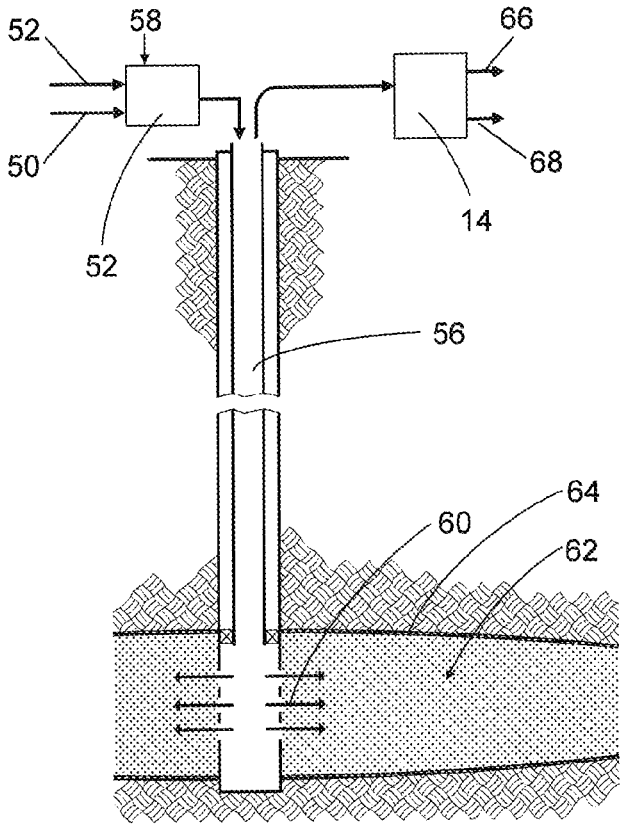
FIG. 6 shows a well being subjected to hydraulic fracturing.

FIG. 6 illustrates the invention being used in connection with a hydraulic fracturing job. The different stages of fracturing and a range of thickeners which may be employed are well known and are not detailed here. Briefly, thickeners 50 are mixed with a supply 52 of water (as schematically indicated at 54) to form a fracturing fluid which is pumped into the production tube 56 of a well. Water-soluble tracer(s) 58 are also mixed into this fracturing fluid. The fracturing fluid flows out of the well as indicated at 60 and causes formation of a fracture 62, with some fluid penetrating into the surrounding formation and depositing a filter cake 64 at the boundary of the fracture. After fracturing of the formation has taken place, fluid is allowed to flow back out of the well and is passed through an oil-water separator 14 so that there are separate flows of oil 66 and water 68. Samples are taken from the water flow 62 and tested for the presence and amount of the tracer(s), by means of an electrochemical procedure in accordance with this invention. Detection and quantitative estimation of tracers in the samples allows the progress of flow back to be monitored and because this can be done in the vicinity of the well, the results are available with little or no delay, as flow back is progressing.

EXAMPLES

Example 1

One possible tracer which may be used in procedures as above is copper ions, conveniently provided as copper (II) sulfate. In order to demonstrate that this is detectable, a solution of 7 ppm copper (II) sulphate pentahydrate in a solution of 150 mM KCl in deionised water was subjected to cyclic voltammetry. A standard experimental setup was used, with a glassy carbon working electrode, a standard calomel electrode (SCE) as reference electrode and a platinum wire as counter electrode.

Figure 7:
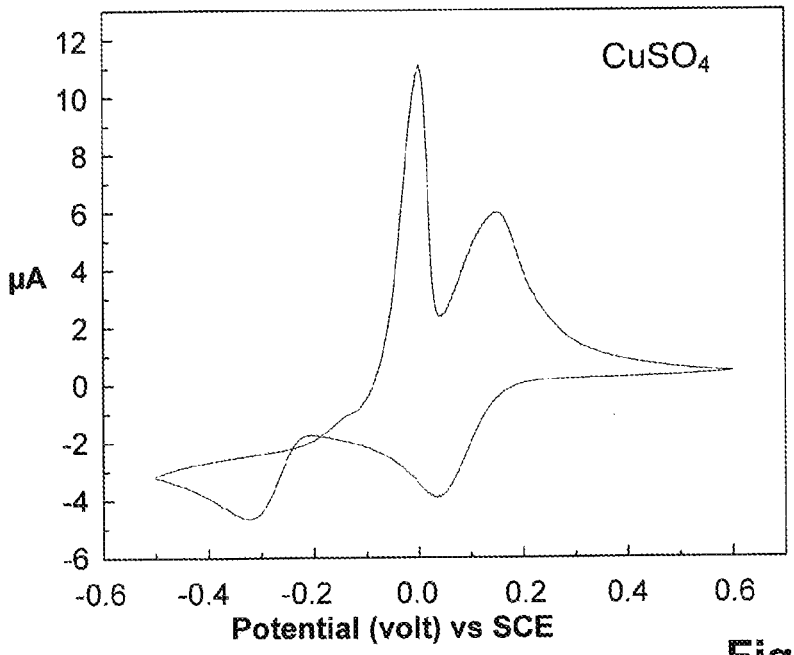
FIG. 7 is a cyclic voltammogram obtained with copper sulphate in saline solution.

FIG. 7 shows the voltammogram obtained. It is a plot of current (in microamps) against applied potential (in volts) relative to the reference electrode. A sharp oxidative wave observed at approximately 0 volt (relative to SCE) is consistent with the oxidation of deposited Cu to Cu(I) whilst the oxidative wave at +0.15 volt is oxidation of Cu(I) to Cu(II). The scan was continued to +0.60 volt and then reversed. Two reductive waves were observed at +0.03 volt and −0.31 volt. These voltammetric signals represent the reduction of Cu(II) to Cu(I) and Cu(I) to elemental Cu respectively.

This demonstrates that copper ions provide a distinctive and easily identifiable voltammogram at concentrations below 10 parts copper sulphate pentahydrate per million.

Example 2

Another possible tracer is barbituric acid. A series of aliquots of this acid were added to a quantity of a formation brine (a saline solution reproducing the analysis of a North Sea formation brine). A square wave anodic voltammogram was taken after each addition had been mixed in. Voltammetry was carried out using a boron doped diamond working electrode, a standard calomel electrode (SCE) as reference and a platinum wire as counter electrode. The composition of the formation brine was: NaCl (27910 ppm), KCl (125 ppm), $MgCl_2$ (650 ppm), $CaCl_2$ (1700 ppm), $SrCl_2$ (250 ppm), $BaCl_2$ (20 ppm), and $KHCO_3$ (145 ppm) prepared in deionised water. The measured pH value of the formation brine was pH 7.6 (at ambient temperature). The square wave used in voltammetry had a frequency of 50 Hz; a step amplitude of 0.02 volt; and increased in potential by 0.002 volt at each step giving an overall scan rate of 0.1 volt/sec.

Figure 8:
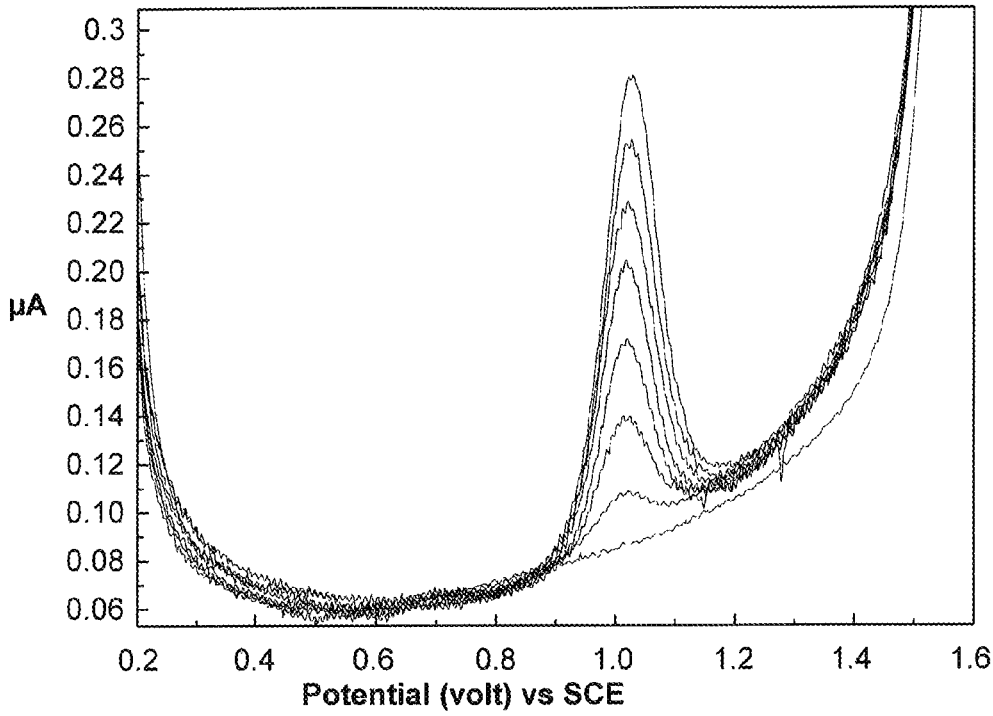
FIG. 8 is a series of square wave voltammograms obtained with barbituric acid in formation brine.
Figure 9:
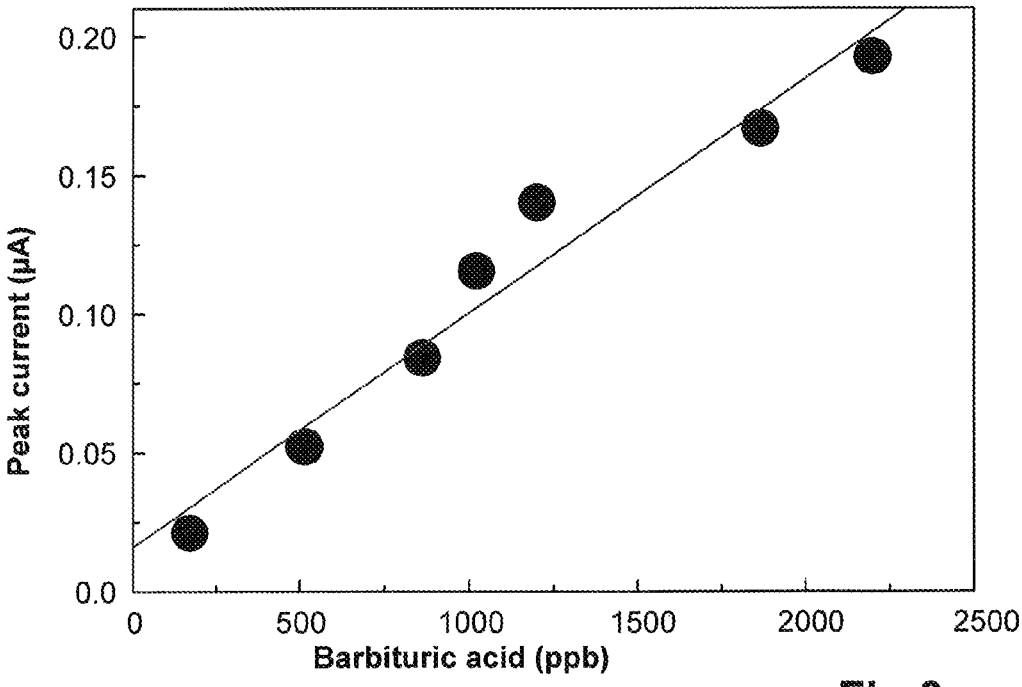
FIG. 9 is a plot of the peak heights in FIG. 8 against barbituric acid concentration.

FIG. 8 shows the voltammograms obtained. In each of the voltammograms, a clearly resolvable, pronounced oxidative peak is apparent with peak potential centred at a redox potential of approximately 1 volt (relative to SCE). FIG. 9 shows the heights of this peak in microamp (after subtracting the baseline value) plotted against barbituric acid concentration and indicates that barbituric acid is detectable at concentrations of approximately 200 ppb and above.

Example 3

Synthesis of Nanoparticles

Synthesis of CdS nanoparticles was performed using Schlenk techniques under nitrogen.

The preparation method was based on arrested precipitation of cadmium sulfide from cadmium chloride solution as disclosed by Barglik-Chory, et al Synthesis, structure and spectroscopic characterization of water-soluble CdS nanoparticles (2003) *Chemical Physics Letters,* 379 (5-6), pp. 443-451 and is schematically illustrated by FIG. 4. The starting materials were cadmium chloride $CdCl_2$ and hexamethyldisilathiane (HMSDT) which has the formula $(CH_3)_3Si—S—Si(CH_3)_3$. These were used together with glutathione which served as a water-soluble capping agent so as to produce nanoparticles of cadmium sulfide with glutathione residues bound to the nanoparticles' surface. Glutathione has the structure:

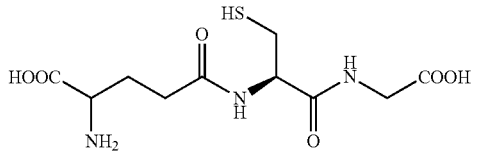

To prepare the nanoparticles, 3.228 g glutathione and 0.799 g $CdCl_2$ were first dissolved in 176 mL deionised water and stirred for 5 mins. Subsequently, 8.5 mL tetramethylammoniumhydroxide (TMAH) and 315 mL ethanol were added and after 10 mins this precursor solution was thoroughly degassed. 0.738 mL hexamethyldisilathiane (HMSDT) was added to the degassed solution, resulting in a clear (slightly yellow) colloidal solution of glutathione-capped CdS nanoparticles. The mixture was magnetically stirred for 1 hour and the prepared particles were precipitated by adding tetrahydrofuran (THF). One day later the supernatant was decanted and the precipitate was purified by re-dispersing it as a colloidal solution in a mixture of equal parts of water and THF and then precipitating again with THF. Finally, the supernatant liquid was decanted and the precipitate was dried under vacuum (<1 mbar).

ZnS and PbS nanoparticles were also prepared by the same procedure, using either zinc acetate or lead acetate in place of cadmium chloride.

Examination of these nanoparticles by scanning electron microscopy showed them to have particle diameter in a range 100-200 nanometres.

Example 4

CdS nanoparticles were dissolved at a concentration of 300 ppb in 0.1M phosphate buffer (pH7) which also contained 0.1M KCl. (Such nanoparticles can have a degree of water solubility in the presence of some anions, but here it is immaterial whether the solution of nanoparticles was a colloidal solution.) CdS nanoparticles were also dissolved at 300 ppb in formation brine of the composition given in Example 2. Each of these colloidal solutions was then subjected to stripping voltammetry using a rotatable glassy carbon working electrode (polished with 1 μm diamond paste before use) together with a standard calomel reference electrode and a platinum wire as counter electrode. The measurements were carried out using an Autolab III computer controlled potentiostat (Eco-Chemie, Netherlands).

To carry out the stripping voltammetry the glassy carbon (GC) electrode was held at a potential of −1.25 volt for a period of 30 seconds to electrochemically reduce and 'deposit' the CdS nanoparticles onto the GC electrode surface. This was the 'deposition' or 'accumulation' stage. During the deposition step the GC electrode was rotated at 1000 rpm to overcome mass-transfer limitations of the otherwise static solution, thus increasing the flow of CdS nanoparticles to the electrode surface.

The electrochemical deposition process, required for deposition of CdS nanoparticles prior to stripping, is believed to occur by a direct mechanism (see Merkoci et al. Nanotechnology, vol 18 (2007) article no. 035502) thus:

$$CdS+2H^{+}+2e^{-}\rightarrow Cd^{0}+H_2S$$

Following the accumulation stage, the 'stripping/detection stage' is invoked by scanning from −1.25 volt to +0.2 volt with a rising square wave having the same waveform as in Example 2.

Figure 10:
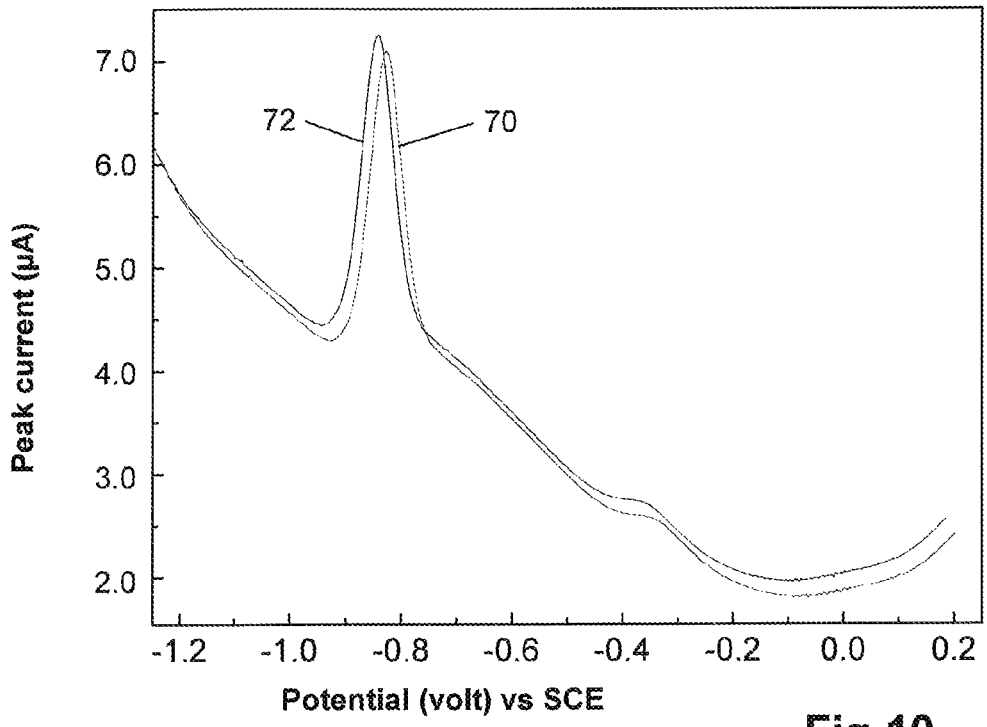
FIG. 10 shows voltammograms obtained by applying stripping voltammetry to cadmium sulfide nanoparticles.

The resulting voltammograms are shown in FIG. 10. Both the sample prepared in phosphate buffer (indicated 70) and the sample prepared in formation brine (indicated 72) displayed well-defined, sharp oxidative stripping peaks. The peak current maxima were at approximately −0.85 volt (relative to SCE). Notably, the peak current magnitude and the potential at which peak current is observed are approximately the same for both samples, i.e. not sensitive to the composition of the cell solution.

Redox signals with the same peak positions and magnitudes were reproducibly obtained over several scans and furthermore the peak position and magnitude did not change if electrodes were polished between scans.

In typical produced water samples there is the unavoidable presence of a low concentration of organic species. In view of this, the above voltammetry was also carried out with approximately 5% by volume of hexane, pentane or dodecane added to the formation brine to represent hydrocarbon contaminants. It was observed that the distinctive peak was still present in the voltammetric signal and that the peak position and magnitude were not affected. This indicates that these nanoparticles would be detectable in produced water samples without extensive sample preparation.

Example 5

Optimisation of Stripping Voltammetry

Figure 11:
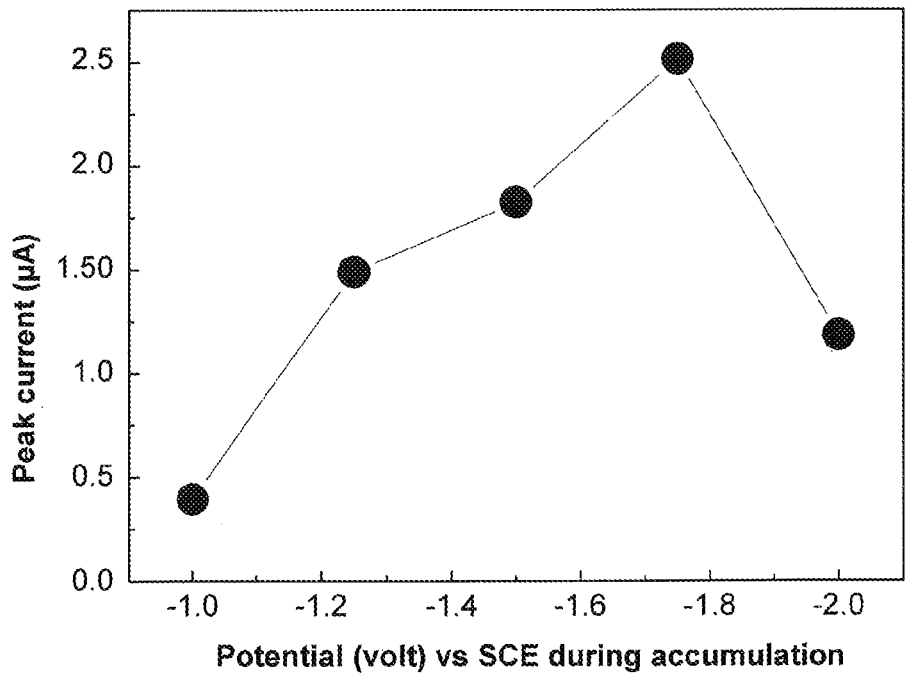
FIG. 11 is a plot of peak height against applied potential in the deposition stage of this stripping voltammetry.

CdS nanoparticles were dissolved at a concentration of 180 ppb in formation brine of the composition given in Example 2. This solution was then subjected to stripping voltammetry generally as in the preceding example, but with a deposition/accumulation time of 60 seconds and various potentials applied to the working electrode during the accumulation stage. FIG. 11 shows the height of the stripping current peak in microamp plotted against potential applied during accumulation. As shown in FIG. 11, it was observed that progressively changing the applied potential from −1 volt to −1.75 volt, which was the optimum potential, led to a considerable increase in peak height. The reduction at −2 volt was attributed to interference from electrolysis of water leading to bubble formation on the electrode.

Figure 12:
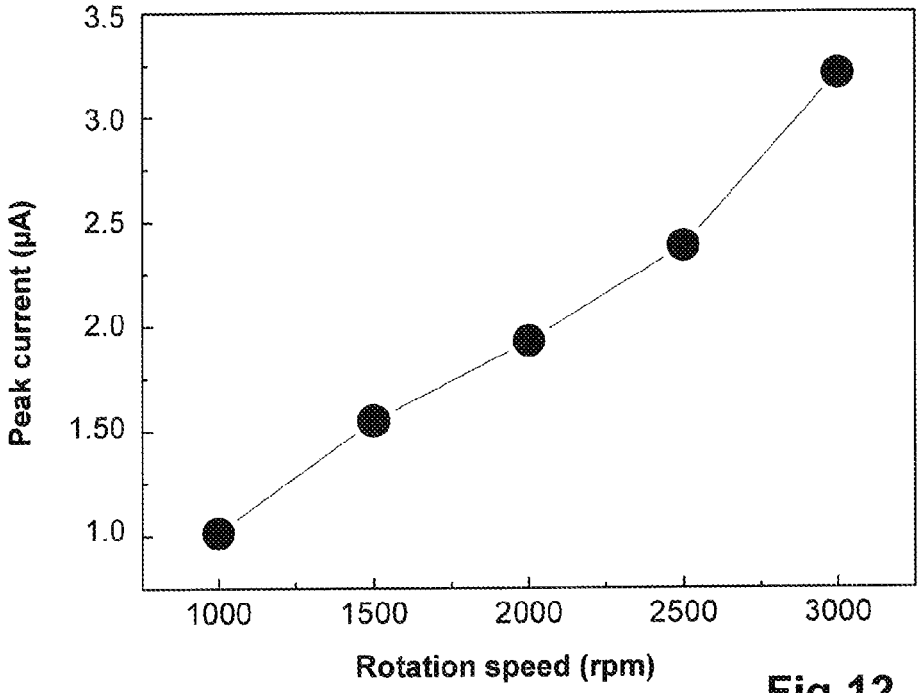
FIG. 12 is a plot of peak height against electrode rotation rate in the deposition stage.

The above experiment was repeated, using an applied potential of −1.75 volt in the accumulation stage, progressively increasing the rotation rate of the glassy carbon electrode. FIG. 12 shows the height of the stripping current peak in microamp plotted against this rotation rate. As shown in FIG. 12 it was observed that a faster rotation rate during the accumulation stage increased the stripping peak current in the detection stage.

Figure 13:
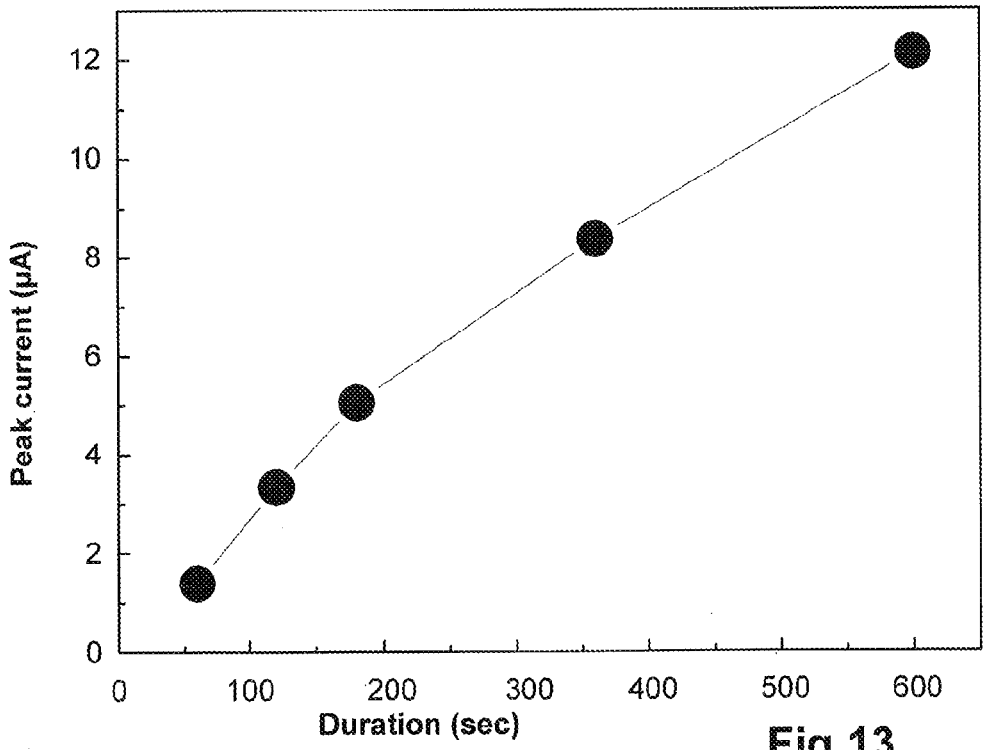
FIG. 13 is a plot of peak height against the duration of the deposition stage.

The experiment was then repeated again, using an applied potential of −1.75 volt and an electrode rotation rate of 3000 rpm, with variation in the length of time given to the accumulation stage. FIG. 13 shows the height of the stripping current peak in microamp plotted against the duration of the accumulation stage. As shown in FIG. 13 it was observed that a ten-fold increase in the duration of the accumulation stage led to a four-fold increase in the peak current in the detection stage. Thus the best conditions tested were a potential of −1.75 volt applied during a accumulation stage lasting 6000 seconds (ten minutes) with the electrode rotated at 3000 rpm. It is possible that even greater sensitivity would be achievable with still longer times and an even faster rotation rate, but the sensitivity was very good under the conditions tested.

Example 6

Detection of Other Nanoparticles

An attempt was made to detect nanoparticles of cadmium, zinc and lead sulfides on a GC working electrode, but only the cadmium sulfide particles were detected. This was rectified by using bismuth chloride as a coabsorbent, as taught by Wang et al *J. Am. Chem. Soc., vol* 125, pages 3214-3215 (2003)

Figure 14:
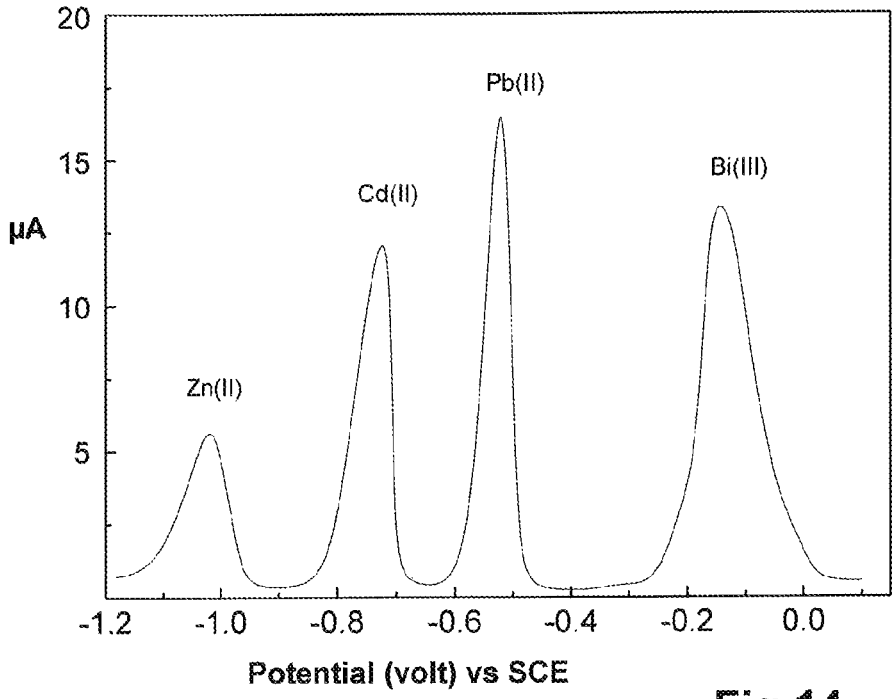
FIG. 14 shows a voltammogram obtained by applying stripping voltammetry to a mixture of three kinds of sulfide nanoparticles.

Nanoparticles of CdS, ZnS and PbS were all dissolved at concentrations of 1000 ppb in formation brine of the composition given in Example 2. 500 ppb of bismuth chloride was also dissolved in this solution. Each colloidal solution was then subjected to stripping voltammetry as in the previous examples, rotating the GC electrode at 3000 rpm and applying a potential of −1.75 volt to this electrode during an accumulation stage of 120 seconds. As shown in FIG. 14 current peaks attributed to ZnS, CdS and PbS were observed at approximately −1.02 volt, −0.72 volt and −0.52 volt (relative to SCE) respectively and a current peak attributed to bismuth (chloride) is observed at approximately −0.14 volt. It can be seen that each peak is discrete, and there is no overlapping of redox signals. Thus, each species yields a voltammetric response that is identifiable and discrete, even in the presence of the other redox active species.

Example 7

Figure 15:
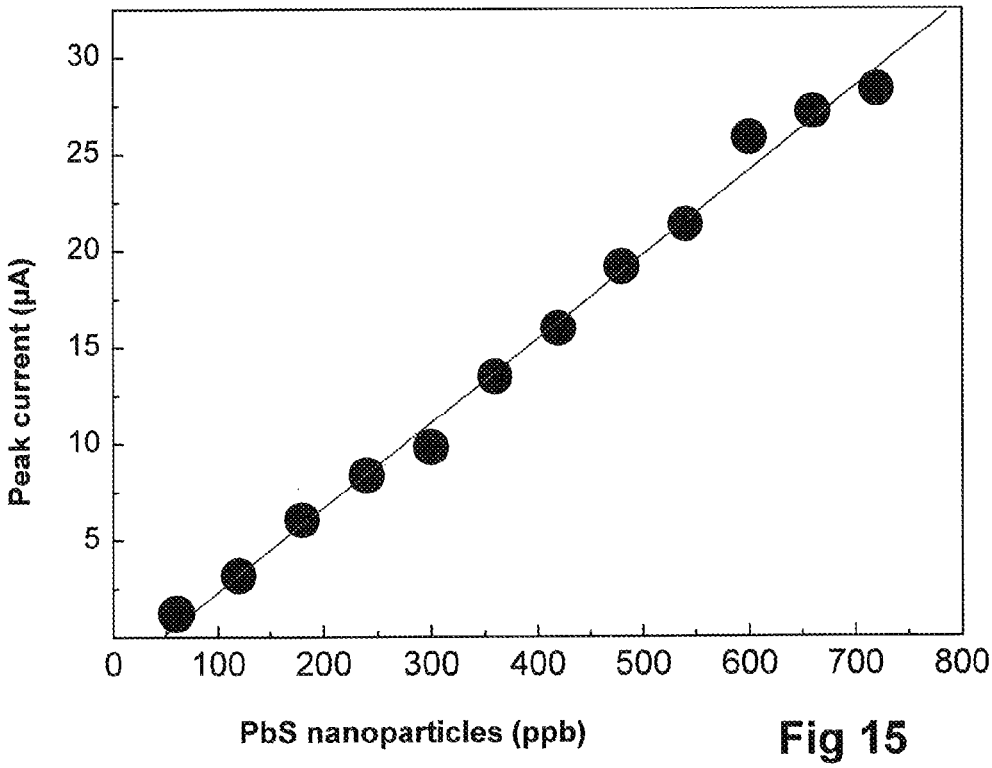
FIG. 15 is a plot of peak height against concentration of lead sulfide nanoparticles.

Aliquots of a stock colloidal solution of PbS nanoparticles were progressively added to formation brine (composition as in Example 2) which also contained 500 ppb bismuth chloride. The solution was subjected to stripping voltammetry using the same conditions as in the previous Example after each addition of nanoparticles. Even at the lowest concentration, which was 60 ppb, there was a clear peak current in the voltammogram showing that PbS nanoparticles are detectable at this low concentration. The stripping peak current increased after each addition of nanoparticles. FIG. 15 is a plot of peak current (after subtracting baseline current) against PbS concentration, showing that the current is proportional to PbS concentration. The same procedure was carried out with CdS nanoparticles, showing them to be detectable at 30 ppb and also with ZnS nanoparticles showing them to be detectable at 130 ppb.

The invention claimed is:

1. A method of monitoring flow within a hydrocarbon well or within a hydrocarbon reservoir penetrated by the well, comprising:

placing one or more tracer materials capable of undergoing a redox reaction at one or more subterranean locations from which they may potentially enter flow produced from the well, causing or allowing release of a said tracer from one or more said locations, and monitoring flow from the well by providing electrodes connected to a source of electrical potential, bringing a sample or portion of the flow into contact with the electrodes and applying potential to the electrodes to bring about an electrochemical reaction while measuring the current flow in order to determine the presence of one or more said tracers in the flow through electrochemical redox reaction of the one or more said tracers.

2. The method according to claim 1 carried out as voltammetry in which potential applied to the electrodes is varied over a range, while measuring the current flow as potential is varied.

3. The method according to claim 2 in which the potential applied to the electrodes is varied in steps superimposed on a progressive variation over a range.

4. The method according to claim 2 in which the voltammetry is stripping voltammetry comprising a first stage of accumulation of tracer on an electrode followed by a shorter second stage in which potential applied to the electrodes is varied over a range, while measuring the current flow as potential is varied.

5. The method according to claim 1 wherein at least one said tracer comprises nanoparticles containing a metal which has more than one oxidation state.

6. The method according to claim 1 wherein a plurality of electrodes are carried on a single substrate.

7. The method according to claim 1 which is a method of monitoring flow within a reservoir from at least one injection well to at least one production well, wherein at least one said tracer is mixed with fluid pumped into a reservoir via the injection well and the step of monitoring flow is applied to flow from the production well.

8. The method according to claim 1 which is a method of monitoring hydraulic fracturing, wherein at least one said tracer is mixed with fracturing fluid pumped into a well and the step of monitoring flow is applied to flow back from the well.

9. The method according to claim 1 which is a method of monitoring flow from a plurality of separate locations for entry of hydrocarbon into a well, wherein different tracers are associated with respective different entry locations.

10. The method according to claim 9 wherein the well comprises valve means for regulating flow from different entry locations.

11. The method according to claim 9 wherein the well comprises at least one lateral subdivided into separate sections, with different tracers associated with respective different sections of the lateral.

12. The method according to claim 1 wherein one or more tracer materials at one or more locations is enclosed within a medium which is degradable in contact with aqueous fluid and thereby allows release of tracer when in contact with aqueous fluid.

13. The method according to claim 1 wherein one or more tracer materials at one or more locations is enclosed within a material which allows tracer to diffuse out of the material when the material is in contact with aqueous fluid.

14. The method of claim 1 comprising accumulating tracer from the flow from the well, providing electrodes connected to a source of electrical potential, bringing accumulated tracer into contact with the electrodes and applying potential to the electrodes to bring about electrochemical reaction, while measuring the current flow.

15. The method of claim 1 wherein causing or allowing release of a said tracer from one or more said locations provides a tracer concentration below 10 parts per million in the flow from the well.

16. The method of claim 1 wherein the tracer materials comprise metal ions with more than one oxidation state.

17. The method of claim 1 wherein the tracer materials comprise inorganic anions capable of electrochemical oxidation or reduction.

18. The method of claim 1 wherein the tracer materials comprise at least one of chloride, bromide, iodide, nitrate and thiocyanate ions, xanthine, ascorbic acid and barbituric acid.

19. A method of monitoring flow within a hydrocarbon well or within a hydrocarbon reservoir penetrated by the well, comprising:

placing one or more tracer materials at one or more subterranean locations from which they may potentially enter flow produced from the well, wherein the one or more tracer materials comprise ions or compounds capable of electrochemical redox reaction;

causing or allowing release of a said tracer from one or more said locations, and monitoring flow from the well by providing electrodes connected to a source of electrical potential, bringing a sample or portion of the flow into contact with the electrodes and applying potential to the electrodes to bring about electrochemical redox reaction of one or more said tracer materials, while measuring the current flow.

20. The method of claim 19 comprising accumulating tracer from the flow from the well, bringing accumulated tracer into contact with the electrodes and applying potential to the electrodes to bring about electrochemical reaction, while measuring the current flow.

21. The method of claim 20 comprising accumulating tracer on an electrode.

22. A method of monitoring flow within a hydrocarbon well or within a hydrocarbon reservoir penetrated by the well, comprising:

placing one or more tracer materials at one or more subterranean locations from which they may potentially enter flow produced from the well, wherein the one or more tracer materials comprise ions or compounds capable of electrochemical redox reaction;

causing or allowing release of a said tracer from one or more said locations, and monitoring flow from the well by providing electrodes connected to a source of electrical potential, applying potential to an electrode during a first stage so as to cause accumulation of tracer on the electrode, followed by varying the potential applied to the electrodes over a range during a second stage which is shorter than the first stage to bring about electrochemical redox reaction of tracer accumulated on the electrode, while measuring the current flow as potential is varied.

* * * * *